US005318881A

United States Patent [19]

Bucci et al.

[11] Patent Number: 5,318,881

[45] Date of Patent: Jun. 7, 1994

[54] METHOD OF PROCESSING A SILVER HALIDE RADIOGRAPHIC MATERIAL

[75] Inventors: Marco Bucci, Genoa; Carlo Marchesano, Savona; Dino Ferrari, Millesimo; Carlo Illuminati, Savona, all of Italy

[73] Assignee: Minnesota Mining and Manufacturing Company, St. Paul, Minn.

[21] Appl. No.: 20,983

[22] Filed: Feb. 22, 1993

[30] Foreign Application Priority Data

Mar. 6, 1992 [IT] Italy ..... MI92 A 000503

[51] Int. Cl.[5] ..... G03C 5/38

[52] U.S. Cl. ..... 430/434; 430/456; 430/478; 430/489; 430/491; 430/492; 430/567; 430/570; 430/963; 430/966

[58] Field of Search ..... 430/434, 455, 456, 478, 430/480, 481, 482, 484, 489, 491, 492, 567, 963, 966

[56] References Cited

U.S. PATENT DOCUMENTS

| | | | |
|---|---|---|---|
| H1,020 | 2/1992 | Nishio et al. . | |
| 4,847,189 | 7/1989 | Suzuki et al. | 430/567 |
| 4,988,603 | 1/1991 | Takamuki et al. | 430/489 |
| 5,028,516 | 7/1991 | Mukunoki et al. | 430/434 |
| 5,112,731 | 5/1992 | Miyasaka | 430/567 |
| 5,153,112 | 10/1992 | Yoshida et al. | 430/963 |

*Primary Examiner*—Janet C. Baxter

*Attorney, Agent, or Firm*—Gary L. Griswold; Walter N. Kirn; Mark A. Litman

[57] ABSTRACT

This invention relates to a method of processing an image-wise exposed silver halide photographic material wherein said method comprises the following steps:

(a) developing the photographic material for 5 to 15 seconds in an aqueous developing solution, (b) fixing the photographic material for 5 to 15 seconds in an aqueous fixing solution, and (c) washing the photographic material for 5 to 20 seconds, wherein both said developing and fixing solutions are free of gelatin hardeners.

The method is particularly intended for use in processing radiographic films which:

comprise a support and silver halide emulsion layer or layers, at least one of said silver halide emulsion layers containing tabular silver halide grains having an average diameter to thickness ratio of at least 3:1 and highly deionized gelatin, and show a swelling index lower than 140% and a melting time of from 45 to 120 minutes.

The method shows the advantages of lower environmental pollution and shorter processing times.

23 Claims, No Drawings

METHOD OF PROCESSING A SILVER HALIDE RADIOGRAPHIC MATERIAL

FIELD OF THE INVENTION

The present invention relates to a method of processing an imagewise exposed silver halide photographic material, and in particular to a super rapid method of processing an imagewise exposed radiographic photographic material without requiring hardening agents in processing solutions.

BACKGROUND OF THE ART

In recent years the increase in consumption of silver halide photographic materials has led to a strong request for a reduction of the processing times.

A reduction in the exposure dose and, at the same time a reduction of the processing time for silver halide medical imaging elements have been strongly demanded in medical circles.

Tabular silver halide grains are crystals possessing two major faces that are substantially parallel. The average diameter of said faces is at least three times the distance separating them (the thickness).

Silver halide photographic emulsions containing a high proportion of tabular grains have advantages of good developability, improved covering power and increased useful adsorption of sensitizing dye per weight of silver due to the high surface area-to-volume ratio of the grains. The use of such emulsions in photographic elements is disclosed in U.S. Pat. Nos. 4,425,425, 4,425,426, 4,433,048, 4,435,499, 4,439,520, and other related patents.

The use of automatic processors for the rapid processing (i.e., for a processing of from 45 to 90 sec) of light-sensitive silver halide elements including tabular silver halide grains, in particular light-sensitive silver halide elements for photographic use, is known. Such elements generally include a support (usually provided with a very thin subbing layer) having coated on at least one side a silver halide gelatin emulsion layer coated in turn with a gelatin protective layer. These elements are transported through machine processing units (developing, fixing, washing and drying) by means of opposed or staggered rollers (as described, for example, in U.S. Pat. No. 3,025,779) which also have the function of squeezing liquid from the film prior to drying.

If rapid processing of a film takes place, several problems occur, such as an inadequate image density (i.e. insufficient sensitivity, contrast and maximum density), insufficient fixing, insufficient washing, and insufficient film drying. Insufficient fixing and washing of a film can cause reduced image quality and modification of the silver tone. In order to reduce the time taken by the element to pass through the processing machine to 0.5 to 2 minutes, as particularly required in rapid processing of photographic elements, the processing is performed at relatively higher temperatures, usually higher than 30° C., preferably between 35° C. and 45° C., such as 38° C., and the gelatin content of the silver halide emulsions is considerably reduced as compared to that of emulsions for manual processing.

Under such conditions, the physical and photographic properties of the elements processed in an automatic processor tend to be worse. With high temperatures and such low gelatin content, for instance, the intrinsic sensitivity to pressure of the silver halide grains gets higher and the elements processed in the automatic processor show repeated marks caused by the pressure of the transporting rollers. Such pressure marks look like higher density regions and reduce the image faithfulness.

In order to prevent pressure marking, various methods have been described in the art. To this purpose, U.S. Pat. No. 2,960,404 describes the use in the photographic elements of glycerine, ethylene glycol and the like, Japanese Pat. No. 5316/1972 describes the use of 1,4-cyclohexane dimethanol and the like, and Japanese Pat. No. 4939/1978 describes the use of trimethylol propane. Another possible method of preventing pressure marking is increasing the degree of hardening of the gelatin layers, in particular of the external protective layers. Also, as another method, photographic elements are known wherein an intermediate gelatin layer is interposed between the support and the emulsion layer. For example, U.S. Pat. No. 3,637,389 describes a rapid processing photographic element wherein gradation, density and sensitivity are improved by applying such an intermediate gelatin layer between the support and the emulsion layer.

However, known methods of preventing pressure marking when used in photographic elements including tabular silver halide grains have proved less effective. In particular, when the hardening degree is increased to achieve a very low swelling index and to improve its resistance to pressure desensitization, the photographic characteristics are reduced. Accordingly, the problem still remains of preventing pressure marking in photographic elements including light-sensitive tabular silver halide emulsions.

EP 238,271 discloses a silver halide photographic material comprising at least one hydrophilic colloidal layer on a support, showing a melting time of from 8 to 45 minutes, and a water content of from 10 to 20 g/m$^2$ upon completion of the washing step. The material is preferably processed in a developing solution comprising indazole and benzotriazole derivatives. The preferred processing time is 45 sec.

U.S. Pat. No. 4,647,528 discloses a method of increasing both covering power and scratching resistance by using a particular polymeric hardener in a photographic material comprising a support coated with at least one silver halide emulsion layer containing tabular silver halide grains with an aspect ratio higher than 5:1. This material is processed in developing and fixing solutions containing hardeners.

U.S. Pat. No. 4,847,189 discloses a silver halide photographic material comprising a silver halide emulsion having tabular silver halide grains with an aspect ratio not lower than 5:1 and showing a melting time of from 8 to 45 minutes. Also disclosed is a method for processing this material in processing solutions containing hardeners in a preferred time of 45 seconds.

EP 341,637 discloses a processing solution for the rapid processing of silver halide photographic material. The processing solution comprises a compound capable of reducing the molecular extinction coefficient at 624 nm of an aqueous solution of a specific carbocyanine sensitizing dye. The processing solution reduces the residual stain and improves photographic characteristics of the processed photographic material.

EP 327,133 discloses a developing solution comprising a thiadiazole derivative. This compound prevent sludge and provides a processed photographic material having good photographic and physical qualities.

EP 321,948 discloses a method to reduce the fixing time by employing a silver halide photographic material comprising a subbing layer which contains an aqueous polymeric latex.

EP 428,455 discloses a developing solution substantially free of both aldehydic hardening agents and silver halide solvents and containing a pyrazolidinone derivative, for use in the development of fore-hardened radiographic films.

However, when performing a super-rapid processing of less than 45 sec the above mentioned disadvantages can not be overcome by these techniques, and thus there is still the need for a method of processing a silver halide photographic material which shows good photographic and physical characteristics when processed in a super-rapid processing.

SUMMARY OF THE INVENTION

The present invention relates to a method of processing an image-wise exposed silver halide photographic material wherein said method comprises the following steps:

(a) developing the photographic material for 5 to 15 seconds in an aqueous developing solution comprising:
  (1) at least one black-and-white developing agent,
  (2) at least one black-and-white auxiliary developing agent,
  (3) at least one antifoggant,
  (4) at least one sequestering agent,
  (5) sulfite antioxidant,
  (6) at least one buffering agent, (b) fixing the photographic material for 5 to 15 seconds in an aqueous fixing solution comprising:
  (1) at least one fixing agent,
  (2) at least one acid compound,
  (3) at least one buffering agent, (c) washing the photographic material for 5 to 20 seconds;

wherein both developing and fixing solutions are free of gelatin hardeners.

In another aspect the present invention relates to a processing chemistry for the processing of a photographic material in a period of time lower than 45 seconds comprising:

(a) an aqueous developing solution free of gelatin hardeners comprising:
  (1) at least one black-and-white developing agent,
  (2) at least one black-and-white auxiliary developing agent,
  (3) at least one antifoggant,
  (4) at least one sequestering agent,
  (5) sulfite antioxidant,
  (6) at least one buffering agent, (b) an aqueous fixing solution free of gelatin hardeners comprising:
  (1) at least one fixing agent,
  (2) at least one acid compound, and
  (3) at least one buffering agent.

In a further aspect the present invention relates to an aqueous fixing solution free of gelatin hardener comprising:

(1) at least one fixing agent,
(2) at least one acid compound, and
(3) at least one buffering agent.

DETAILED DESCRIPTION OF THE INVENTION

The present invention relates to a method of processing an image-wise exposed silver halide photographic material wherein said method comprises the following steps:

(a) developing the photographic material for 5 to 15 seconds in an aqueous developing solution comprising:
  (1) at least one black-and-white developing agent,
  (2) at least one black-and-white auxiliary developing agent,
  (3) at least one antifoggant,
  (4) at least one sequestering agent,
  (5) sulfite antioxidant,
  (6) at least one buffering agent, (b) fixing the photographic material for 5 to 15 seconds in an aqueous fixing solution comprising:
  (1) at least one fixing agent,
  (2) at least one acid compound,
  (3) at least one buffering agent, and (c) washing the photographic material for 5 to 20 seconds;

wherein both developing and fixing solutions are free of gelatin hardeners.

The components of the aqueous developer to be used in the present invention will hereinafter be explained in detail.

The developing agents for silver halide photographic elements suitable for the purposes of the present invention include hydroquinone and substituted hydroquinones (e.g. t-butylhydroquinone, methylhydroquinone, dimethylhydroquinone, chlorohydroquinone, dichlorohydroquinone, bromohydroquinone, 1,4-dihydroxynaphthalene, methoxyhydroquinone, ethoxyhydroquinone, etc.). Hydroquinone, however, is preferred. Said silver halide developing agents are generally used in an amount from about 2 to 100 grams per liter, preferably 6 to 50 grams per liter of the ready-to-use developer composition.

Such developing agents can be used alone or in combination with auxiliary developing agents which show a superadditive affect, such as p-aminophenol and substituted p-aminophenol (e.g. N-methyl-p-aminophenol, also known as metol and 2,4-diaminophenol) and pyrazolidones (e.g. 1-phenyl-3-pyrazolidone, also known as phenidone) and substituted pyrazolidones (e.g., 4-methyl-1phen-yl-3-pyrazolidone, 4-hydroxymethyl-4-methyl-1-phenyl-3-pirazolidone, also known as dimezone S, and 4,4'-dimethyl-1-phenyl-3-pyrazolidone, also known as dimezone). These auxiliary developing agents are generally used in an amount from about 0.1 to 10, preferably 0.5 to 5 grams per liter of ready-to-use developer composition. Phenidone is the preferred auxiliary developing agent to be used into the developer of the present invention.

The antifogging agents, known in the art to eliminate fog on the developed photographic silver halide films, useful in the developer composition of this invention include derivatives of benzimidazole, benzotriazole, tetrazole, indazole, thiazole, etc. Preferably, according to the present invention, the developer comprises a combination of benzotriazole-, indazole- and mercaptoazole-type antifoggants, more preferably a combination of 5-methylbenzotriazole, 5-nitroindazole and 1-phenyl-5-mercaptotetrazole. Other examples of mercaptoazoles are described in U.S. Pat. No. 3,576,633, and other examples of indazole type antifoggants are described in U.S. Pat. No. 2,271,229. More preferably, particular mixtures of these antifogging agents are useful to assure low fog levels; such preferred mixtures include mixtures of 5-nitroindazole and benzimidazole nitrate, 5-nitrobenzotriazole and 1-phenyl-1-H-tetrazole-5-thiol and 5-methylbenzotriazole and 1-phenyl-1-H-tetrazole-5-thiol. The most preferred combination is 5-methylbenzotriazole and 1-phenyl-1-H-tetrazole-5-thiol. These mixtures are used in a total amount of from about 0.01 to 5, preferably 0.02 to 3 grams per liter of the ready-to-use developer composition. Of course optimum quantities of each compound and proportion can be found by the skilled in the art to respond to specific technical needs. In particular, 5-methylbenzotriazoles have been found to give the best results when used in mixture with 1-phenyl-1-H-tetrazole-5-thiol, the latter being present in minor amount with respect to the weight of the total mixture, in a percent of less than 20%, preferably less than 10%.

The developer, comprising said antifoggant combination, is advantageously used in a continous transport processing machine at high temperature processing (higher than 30° C.) for processing of X-ray materials without changes in the sensitometric properties of the material, mainly without a substantial increase of the fog of the developed material.

The sequestering agents used in the present invention are sequestering agents known in the art such as, for example, aminopolycarboxylic acids (ethylenediaminotetraacetic acid, diethylenetriaminepentaacetic acid, nitrilotriacetic acid, diaminopropanoltetraacetic acid, etc.), aminopolyphosphonic acids (methylaminophosphonic acid, phosphonic acids described in Research Disclosure 18837 of December 1979, phosphonic acids described in U.S. Pat. No. 4,596,764, etc.), cyclicaminomethane diphosphonic acids (as described in EP Appl. No. 286,874), polyphosphate compounds (sodium hexametaphosphate, etc.), α-hydroxycarboxylic acid compounds (lactic acid, tartaric acid, etc.), dicarboxylic acid compounds (malonic acid, etc.), α-ketocarboxylic acid compounds as described in U.S. Pat. No. 4,756,997 (pyruvic acid, etc.), alkanolamine compounds (diethanolamine, etc.), etc.

The above sequestering agents can be used alone or in combination with each other. More preferably, particular mixtures of these sequestering agents are useful to assure strong resistence to air oxidation; such preferred mixtures include mixtures of aminopolycarboxylic acids and cyclicaminomethane diphosphonic acids as described in EP 446,457. Said sequestering agents can be advantageously used in a total amounts of from about 1 to about 60 grams per liter, preferably of from about 2 to about 30 grams per liter of ready-to-use developer. Of course optimum quantities of each compound and proportion can be found by the skilled in the art to respond to specific technical needs. The sequestering agents incorporated into the black-and-white developer of the present invention have been found to increase the stability of the developer over a long period of time.

The term "sulfite antioxidants", is meant those compounds known in the art as capable of generating sulfite ions ($SO_3^-$) in aqueous solutions and include sulfites, bisulfites, metabisulfites (1 mole of metabisulfite forming 2 moles of bisulfite in aqueous solution). Examples of sulfites, bisulfites, and metabisulfites include sodium sulfite, sodium bisulfite, sodium metabisulfite, potassium sulfite, potassium bisulfite, potassium metabisulfite and ammonium metabisulfite. The amount of the total sulfite ions is preferably not less than 0.05 moles, more preferably 0.1 to 1.25 moles, and most preferably 0.3 to 0.9 moles, per liter of developer. The amount of the sulfite ions with respect to the hydroquinone preferably exceeds a molar ratio of 2.5:1 and, more preferably, is between 2.5:1 to 4:1.

The developer in accordance with the present invention further includes a buffer (e.g., carbonic acid salts, phosphoric acid salts, polyphosphates, metaborates, boric acid and boric acid salts). In a preferred embodiment of the present invention the developer is free of boric acid and boric acid salts. The amount of the buffer with respect to the sulfite preferably exceeds a molar ratio of 0.5:1 and, more preferably, is between 1:1 to 2:1.

The photographic developer of the present invention can further comprise silver halide solvents. Useful silver halide solvents are solutions or compounds well known in the art, such as soluble halide salts, (e.g., NaBr, KCl), thiosulfates (e.g. sodium thiosulfate, potassium thiosulfate and ammonium thiosulfate), sulfites (e.g., sodium sulfite), ammonium salts (e.g. ammonium chloride), thiocyanates (e.g., potassium thiocyanate, sodium thiocyanate, ammonium thiocyanate), thiourea, imidazole compounds (e.g., 2-methylimidazole as described in U.S. Pat. No. 3,708,299) and thioether compounds, Alkali metal or ammonium salts of thiosulfates and thiocyanates, alone or in combination with each other are preferred. The amount of the silver halide solvent used varies depending on the type of the silver halide solvent. The total amount of the silver halide solvents is generally comprised in the range of from 0.01 to 50 mMoles per liter, more preferably in the range of from 0.1 to 30 mMoles per liter of ready-to-use developer composition.

In the developer composition are inorganic alkaline agents to obtain the preferred pH which is usually higher than 10. Said inorganic alkaline agents include KOH, NaOH, LiOH, sodium and potassium carbonate, etc.

Other adjuvants well known in the art of developer formulation may be added to the developer of the present invention. These include restrainers, such as the soluble halides (e.g., KBr), solvents (e.g., polyethylene glycols and esters thereof), development accelerators (e.g., polyethylene glycols and pyrimidinium compounds), preservatives, surface active agents, and the like.

The developer of the invention is prepared by dissolving the ingredients in water and adjusting the pH to the desired value. The pH value of the developer of the present invention is comprised in the range of from 9 to 12, more preferably of from 10 to 11. The developer may also be prepared in a single concentrated form and then diluted to a working strength just prior to use. The developer may also be prepared in two or more concentrated parts to be combined and diluted with water to the desired strength and placed in the developing tank of the automatic processing machine.

The developer of the present invention is particularly useful when processing is carried out in an automatic processing machines. Automatic processing machines may be of the type of the series of "TRIMATIC TM" Processors made by 3M Company.

The components of the aqueous fixer to be used in the present invention will hereinafter be explained in detail.

The fixing agents for silver halide photographic elements suitable for the purposes of the present invention include thiosulfates, such as ammonium thiosulfate, sodium thiosulfate, potassium thiosulfate; thiocyanates, such as ammonium thiocyanate, sodium thiocyanates; sulfites, such as sodium sulfite, potassium sulfite; ammonium salts, such as ammonium bromide, ammonium chloride; and the like.

Acid compounds which can be used in the fixing solution according the present invention are sodium or potassium metabisulfates, boric acid, acetic acid, and the like.

The fixing solution in accordance with the present invention can further include a buffer (e.g., carbonic acid salts, phosphoric acid salts, polyphosphates, metaborates, boric acid and boric acid salts, acetic acid and acetic acid salts, and the like).

Other components usually employed in fixing bath are disclosed, for example, in L. F. A. Mason, "Photographic Processing Chemistry", pp. 179-195, Focal Press Ltd., and in D. H. O. John, "Radiographic Processing", pp. 152-178, Focal Press Ltd., London.

In a preferred embodiment the fixing solution of the present invention are free of boric acid and/or boric acid salts. The aim of boric acid is substantially related to its binding properties relative to the aluminum ion (used as gelatin hardener in prior art fixing solutions). If the aluminum is bonded by boric acid, the formation of sludge due to aluminum complex (mainly Al(OH)3) is reduced or avoided. In absence of gelatin hardener containing aluminum, boric acid and derivatives thereof can be omitted from the fixing solution, so obtaining a less polluting solution.

In a more preferred embodiment the fixing solution of the present invention comprises soluble iodide salts, such as, for example, sodium iodide, potassium iodide, and the like. These soluble iodide salts are generally used in an amount of at least 30, preferably at least 50 mg per liter of ready-to-use fixing solution.

The processing chemistry of the present invention is particularly intended for use in processing photographic films which:

comprise a support and silver halide emulsion layer or layers, at least one of said silver halide emulsion layers containing tabular silver halide grains having an average diameter to thickness ratio of at least 3:1 and highly deionized gelatin, and show a swelling index lower than 140% and a melting time of from 45 to 120 minutes.

As employed herein swelling index refers to the percent swell obtained by (a) conditioning the photographic element at 38° C. for 3 days at 50% relative humidity, (b) measuring the layer thickness, (c) immersing the photographic element in distilled water at 21° C. for 3 minutes, and (d) determining the percent change in layer thickness as compared to the layer thickness measured in step (b). The swelling index is represented by the following formula:

$$SW.IND. = \frac{TH_d - TH_b}{TB_b}$$

wherein THd and THb are respectively the thickness measured at step (d) and (b). It is preferred that the photographic element for use in the present invention shows a swelling index lower than 140%.

As employed herein the term melting time refers to the time from dipping into an aqueous solution of 1.5% by weight of NaOH at 50° C. a silver halide photographic material cut into a size of 1×2 cm until at least one of the silver halide emulsion layers constituting the silver halide photographic material start to melt. Reference to this method can also be found in U.S. Pat. No. 4,847,189. It is preferred that the photographic element for use in the present invention shows a melting time of from 45 to 120 minutes.

A silver halide photographic material showing the above mentioned values of melting time and swelling index can be processed in a super-rapid processing of less than 45 seconds, preferably of less than 30 seconds, from the insertion of the photographic material in an automatic processor to the exit thereof, using the hardener free developing and fixing solutions of the present invention. In these conditions the physical and photographic characteristics of the photographic element can be equal to or better than the physical and photographic characteristics obtained with rapid processing of from 45 to 90 seconds.

The highly deionized gelatin which can be used is characterized by a higher deionization with respect to the commonly used photographic gelatins. Preferably, the gelatin is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of $Ca^{++}$ ions and the significant presence of other ions.

The highly deionized gelatin can be employed not only in silver halide emulsion layers containing tabular silver halide grains, but also in other component layers of the photographic material, such as silver halide emulsion layers containing other than tabular silver halide grains, overcoat layers, interlayers and layers positioned beneath the emulsion layers. Preferably at least 50%, more preferably at least 70% of the total hydrophilic colloid of the photographic material comprises highly deionized gelatin.

The tabular silver halide grains contained in the silver halide photographic material useful in the present invention have an average diameter:thickness ratio (often referred to in the art as aspect ratio) of at least 3:1, preferably 3:1 to 20:1, more preferably 3:1 to 14:1, and most preferably 3:1 to 8:1. Average diameters of the tabular silver halide grains range from about 0.3 to about 5 micrometeres, preferably 0.5 to 3 micrometers, more preferably 0.8 to 1.5 micrometers. The tabular silver halide grains have a thickness of less than 0.4 micrometers, preferably less than 0.3 micrometers and more preferably less than 0.2 micrometers.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 micrometers, as compared to the projected area of all of the silver halide grains in the layer. Other conventional silver halide grain structures such as cubic, orthorhombic, tetrahedral, etc. may make up the remainder of the grains.

Commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5% mol silver iodide. The halogen composition of individual grains may be homogeneous or heterogeneous.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121-125, in Gutoff, "Nucleation and Growth Rates During the Precipitation of Silver Halide Photographic Emulsions", Photographic Science and Engineering, Vol. 14, No. 4 (1970), pp. 248-257,in Berry et al., "Effects of Environment on the Growth of Silver Bromide Microcrystals", Vol.5, No.6 (1961), pp. 332-336, in U.S. Pat. Nos. 4,063,951, 4,067,739, 4,184,878, 4,434,226, 4,414,310, 4,386,156, 4,414,306 and in EP Pat. Appln. No. 263,508.

The silver halide materials useful in the method of the present invention can be sensitized to the UV, blue and green portion of the electromagnetic spectrum. Typical spectral sensitizing dye comprise cyanines, hemicyanines, merocyanines, oxonols, hemyoxonols, styryls, merostyryls, streptocyanines and the like. Examples of blue and green sensitizing dyes can be found in *Research Disclosure*, December 1989, Vol 309, Item 309119, Section IV.

The silver halide photographic materials useful in the method of the present invention could also be sensitized to the red and infrared portion of the electromagnetic spectrum. Typical infrared light-sensitive photographic material are intended for use with laser diode emitting from 780 to 900 nm. Examples of infrared sensitizing dyes are disclosed in U.S. Pat. Nos. 2,104,064: 2,734,900; 2,895,955; 3,128,179, 3,682,630; 4,362,800; 3,582,344; 4,515,888; 4,975,362 and 5,013,642; in EP Pat. Applications 420,012 and 420,011; in *Photographic Chemistry*, Vol. 2, P. Glafkides, 1960, Fountain Press, Chapter XL, pages 882-901 and in *The theory of the Photographic Process*, 3rd Ed. Mees and James, 1966, Chapter 11, esp. pp. 199 and 205.

The silver halide photographic material useful in the method of the present invention can be prepared by coating the light-sensitive silver halide emulsion layer or layers and other auxiliary layers on a support. Examples of materials suitable for the preparation of the support include glass, paper, polyethylene-coated paper, metals, organic polymeric film, cellulose nitrate, cellulose acetate, polystyrene, polyethylene terephthalate, polyethylene, polypropylene and other well known supports.

Preferred silver halide photographic materials for use in this invention are radiographic light-sensitive materials comprising a silver halide emulsion layer or layers coated on one surface, preferably on both surfaces of a support, preferably a polyethylene terephthalate support, wherein at least one of said silver halide emulsion layers contains tabular silver halide grains having an average diameter:thickness ratio of at least 3:1 and highly deionized gelatin, and having a swelling index lower than 140% and a melting time of from 45 to 120 minutes, In a more preferred embodiment of the photographic material useful in the method of the present invention the above mentioned values of swelling index and melting time can be satisfied by a light-sensitive silver halide radiographic element comprising a support and silver halide emulsion layer or layers, wherein at least one of said silver halide emulsion layers contains tabular silver halide grains having an average diameter:-thickness ratio of at least 3:1 and highly deionized gelatin hardened with a bi-,tri-, or tetra-vinylsulfonyl substituted organic hydroxy compound of formula $(CH_2{=}CH{-}SO_2{-})_n{-}A$, wherein A is an n-valent organic group containing at least one hydroxy group and n is 2,3 or 4.

In the above general formula, the group A represents an n-valent acyclic hydrocarbon group, 5 or 6 membered heterocyclic group containing at least one nitrogen, oxygen or sulfur atom, a 5 or 6 membered alicyclic group or an at least 7 carbon atoms aralkylene group. Each of those A groups may either have a substituent or combine with each other through a hetero atom, for example, a nitrogen, oxygen and/or sulfur atom, or a carbonyl or carbonamido group.

In the above general formula, the group A may be advantageously any organic divalent group, preferably an acyclic hydrocarbon group such as an alkylene group having 1 to 8 carbon atones, e.g., a methylene group, an ethylene group, a trimethylene group, a tetramethylene group, etc., or an aralkylene group having a total of 8 to 10 carbon atoms. One to three of the carbon atoms of the group defined above for A can be replaced by a hetero atom such as a nitrogen atom, an oxygen atom, a sulfur atom, etc. Also, the group A can be additionally substituted, for example, with one or more alkoxy groups having 1 to 4 carbon atoms such as a methoxy group, an ethoxy group, etc., a halogen atom such as a chlorine atom, a bromine atom, etc., an acetoxy group and the like.

Examples of the hydroxy substituted vinyisulfonyl hardeners can be found, together with the method of preparation thereof, in U.S. Pat. No. 4,173,481.

Preferably, the silver halide emulsions are coated on the support at a total silver coverage in the range of 3 to 6 grams per square meter. Usually, the X-ray light-sensitive materials are associated with intensifying screens so as to be exposed to radiation emitted by said screens. The screens are made of relatively thick phosphor layers which transform the X-rays into light radiation (e.g., visible light). The screens absorb a portion of X-rays much larger than the light-sensitive material and are used to reduce the X-ray dose necessary to obtain a useful image. According to their chemical composition, the phosphors can emit radiation in the blue, green or red region of the visible spectrum and the silver halide emulsions are sensitized to the wavelength region of the light emitted by the screens. Sensitization is performed by using spectral sensitizing dyes adsorbed on the surface of the silver halide grains as known in the art.

Some illustrative examples will be described hereinbelow for assistance in understanding the invention.

EXAMPLE 1

Silver halide grain emulsions having the grain morphology indicated in table 1 were prepared in the presence of deionized gelatin having a viscosity at 60° C. in water at 6.67% w/w of 4.6 mPas, a conducibility at 40° C. in water at 6.67% w/w of less than 150 μS/cm and less than 50 ppm of $Ca^{++}$.

TABLE 1

| Emulsion | 1 | 2 |
|---|---|---|
| Shape | Cubic | Tabular |
| Composition | AgBrI | AgBr |
| 1% Mol | 2.3 | — |
| Diameter | 0.7 | 1.34 |
| Thickness | | 0.19 |
| Aspect ratio | | 7.05 |
| Projective area | | >50% |

Projective area and aspect ratio are obtained by considering all the grains having a thickness of less than 0.4 micrometers.

The above emulsions were chemically sensitized with sodium p-toluenthiosulfonate, sodium p-toluensulfinate and benzothiazoleiodoethylate and optically sensitized to green light with a cyanine dye and potassium iodide. At the end of the chemical digestion, not deionized gelatin (having a viscosity at 60° C. in water at 6.67% w/w of 5.5 mPas, a conducibility at 40° C. in water at 6.67% w/w of 1,100 μS/cm and 4,500 ppm of $Ca^{++}$) was added to the emulsion in an amount to have 83% by weight of deionized gelatin and 17% by weight of not deionized gelatin. The emulsions were added with a wetting agent and 5-methyl-7-hydroxytriazaindolizine stabilizer. Cubic emulsion 1 was added with 3.5% by weight (relative to gelatin) of dimethylolurea hardener, tabular emulsion 2 was added with 3.5% by weight (relative to gelatin) of 1,3-bisvinylsulfonyl-2-propanol. Then each emulsion was coated, at pH=6.7, on each side of a blue polyester film support at a silver coverage of 2.05 g/m² and gelatin coverage of 2.85 g/m² per side. A non deionized gelatin protective supercoat containing 0.91 g/m² of gelatin per side and 2% by weight (relative to gelatin) of the hardeners above was applied on each coating at pH=6.7. Two films A1 and A2 were respectively obtained from emulsions 1 and 2. Film A1 shows a melting time of 9 minutes and a swelling index of 178%, film A2 shows a melting time of 65 minutes and a swelling index of 106%. The two films in the form of sheets were stored for 15 hours at 50° C., exposed to white light and processed in processors 1 and 2. Processor 1 is a 3M Trimatic TM XP515 automatic processor with a total processing time of 90 sec. Processor 2 is a 3M Trimatic TM XP515 without drying system. The processing time of processor 2 is variable and indicated in each following table. The development, fixing and washing time with respect of the total processing time are respectively in the range of from 25% to 40%, preferably the developing time being about 35%, the fixing time being about 35%, and the washing time being about 30% of the total processing time.

The following ready-to-use developing bath compositions were used in processing the above mentioned films.

TABLE 2

| Developer | | D1 Control | D2 Inv. | D3 Inv. | D4 Comp. | D5 Comp. |
|---|---|---|---|---|---|---|
| Water | g | 700 | 700 | 700 | 700 | 700 |
| $Na_2S_2O_5$ | g | 45 | 40 | 84 | 8.85 | 8.85 |
| $K_2S_2O_5$ | g | — | — | — | 71.5 | 71.5 |
| KOH 35% (w/w) | g | 105 | 107 | 135 | 60 | 78 |
| $K_2CO_3$ | g | 13.25 | 13.25 | 44 | — | — |
| $NaHCO_3$ | g | — | — | — | 7.5 | 7.5 |
| $CH_3COOH$ | g | 7.5 | 7.5 | — | — | — |
| Ethyleneglycol | g | 10 | 10 | — | — | — |
| Diethyleneglycol | g | 5 | 5 | 20 | 20 | 20 |
| DTPA.5Na 40% (w/w) | g | — | — | — | 7.1 | 7.1 |
| EDTA.4Na | g | 1.5 | 1.5 | 2 | — | — |
| BUDEX 5103.2Na 40% (w/w) | g | 7.5 | 7.5 | 7.5 | — | — |
| Boric acid | g | 1.7 | 1.7 | 2 | — | — |
| 5-methyl-benzo-triazole | g | 0.08 | 0.08 | 0.15 | 0.12 | 0.12 |
| 5-nitro-indazole | g | 0.107 | 0.107 | — | — | — |
| 1-Phenyl-1-H-tetra-zole-5-thiol | g | 0.007 | 0.007 | 0.067 | — | — |
| Hydroquinone | g | 20 | 20 | 30 | 32 | 51.3 |
| Phenidone | g | 1.45 | 1.45 | 2.5 | — | — |
| DEA* | g | — | — | — | 5 | 3.67 |
| Glutaraldehyde | g | 7.2 | — | — | — | — |
| Sodium bromide | g | 5 | 5 | 2 | 2.25 | 2.25 |
| Water to make | l | 1 | 1 | 1 | 1 | 1 |
| pH at 20° C. | | 10.35 | 10.35 | 11.10 | 10.50 | 10.70 |

*The comparison examples D4 and D5 respectively contain 5 and 3.67 grams of Developing Enhancing Agent (4-hydroxymethyl-4-methyl-1-phenyl-3-pyrazolidone), according to EP 428,455.

The following ready-to-use fixing bath compositions were used in processing the above mentioned films.

TABLE 3

| FIXER | | F1 Control | F2 Inv. | F3 Inv. |
|---|---|---|---|---|
| $(NH_4)_2S_2O_3$ 60% (w/w) | g | 242 | 242 | 242 |
| $Na_2SO_3$ | g | 8.12 | 8.12 | 8.12 |
| Boric acid | g | 7 | 7 | — |
| $NH_4OH$ 25% (w/w) | g | 17 | 17 | 15 |
| $CH_3COOH$ | g | 22.5 | 22.5 | 20 |
| KI | g | 0.05 | 0.05 | 0.05 |
| $Al_2(SO_4)_3$ | g | 7.74 | — | — |
| $H_2SO_4$ | g | 3.58 | — | — |
| 2-Phenyl-ethanol | g | 0.118 | — | — |
| Water to make | l | 1 | 1 | 1 |
| pH at 20° C. | | 4.30 | 5.0/5.2 | 5.0/5.2 |

The following table 4 shows the sensitometric results of films A1 and A2, and of the commercially available Kodak TMG-RA film (A3), obtained using processor 1. The residual stain and silver tone evaluations are expressed by to scholastic score (7=very good, 6=good, 5=quite good, 4=sufficient, 3=insufficient, 2=inadeguate).

TABLE 4

| Film | Devel. | Fixer | D. min | D. max | Speed | Contr. | Stain | Tone |
|---|---|---|---|---|---|---|---|---|
| A1 | D1 c | F1 c | 0.20 | 3.45 | 2.58 | 2.65 | 4 | 4 |
| A1 | D2 i | F2 i | 0.21 | 3.50 | 2.58 | 2.60 | 5 | 5 |
| A1 | D3 i | F2 i | 0.21 | 3.45 | 2.50 | 2.65 | 5 | 5 |
| A2 | D1 c | F1 c | 0.21 | 3.75 | 2.60 | 2.60 | 3 | 3 |
| A2 | D2 i | F2 i | 0.21 | 3.70 | 2.59 | 2.55 | 7 | 6 |
| A2 | D3 i | F2 i | 0.22 | 3.70 | 2.60 | 2.70 | 5 | 6 |
| A2 | D4 c | F2 i | 0.22 | 3.70 | 2.60 | 2.55 | 4 | 4 |
| A2 | D5 c | F1 c | 0.22 | 3.70 | 2.60 | 2.55 | 4 | 4 |
| A3 | D2 i | F2 i | 0.23 | 3.65 | 2.55 | 2.60 | 4 | 4 |

TABLE 4-continued

| Film | Devel. | Fixer | D. min | D. max | Speed | Contr. | Stain | Tone |
|---|---|---|---|---|---|---|---|---|
| A3 | D4 c | F1 c | 0.23 | 3.60 | 2.56 | 2.55 | 3 | 3 |

(c = comparison i = invention)

No significative variations are noted in terms of sensitometry. Residual stains and silver tone are improved by using the developer and fixer D2 and F2 of the present invention relative to the control and comparison developers and fixers. In particular the best results are obtained by using the film A2.

In the following table 5 are tabulated the processing times needed to get the same values of standard sensitoinetry of table 4 using processor 2.

TABLE 5

| Film | Devel. | Fixer | Cycle time | Dmin | Dmax | Speed | Contr. |
|---|---|---|---|---|---|---|---|
| A2 | D1 c | F1 c | 90 sec | 0.21 | 3.70 | 2.60 | 2.60 |
| A2 | D2 i | F2 i | 45 sec | 0.21 | 3.65 | 2.59 | 2.55 |
| A2 | D3 i | F2 i | 30 sec | 0.22 | 3.75 | 2.61 | 2.70 |
| A3 | D4 c | F1 c | 35 sec | 0.22 | 3.60 | 2.58 | 2.55 |

The data of Table 5 clearly show the reduction of processing time by using developer and fixer of the present invention.

The following table 6 shows the physical property results of films A1 and A2, and of the commercially available Kodak TMG-RA film (A3). The roller mark and hard mottle evaluations are expressed in scholastic scores (1=insufficient, 2=sufficient, 3=good, 4=very good).

TABLE 6

| Film | Develop. | Fixer | Roller Mark | Hard mottle | Clearing time |
|---|---|---|---|---|---|
| A1 | D1 c | F1 c | 3 | 4 | 11 sec |
| A1 | D2 i | F1 i | 1 | 2 | 11 sec |
| A2 | D1 c | F1 c | 3 | 4 | 9 sec |
| A2 | D2 i | F2 i | 3 | 4 | 8 sec |
| A2 | D4 c | F1 c | 3 | 3 | 10 sec |
| A3 | D2 i | F2 i | 3 | 4 | 10 sec |
| A3 | D4 c | F1 c | 3 | 3 | 15 sec |

The physical properties remain substantially unvaried, but we have a shorter clearing time by using developer and fixer of the present invention.

The following table 7 shows the water absorption values of the radiographic film processed in the processing solutions of the present invention and in comparison processing solutions.

TABLE 7

| Film | Developer | Fixer | Water absorption ($g/m^2$) |
|---|---|---|---|
| A1 | D1 c | F1 c | 17 |
| A1 | D2 i | F2 i | 25 |
| A2 | D1 c | F1 c | 15 |
| A2 | D2 i | F2 i | 20 |
| A2 | D4 c | F1 c | 19 |
| A3 | D2 i | F2 i | 24 |
| A3 | D4 c | F1 c | 19 |

Water absorption of films A2 and A3 processed in D2-F2 line is slightly higher than films A2 and A3 processed in D1-F1, but this does not significantly affect the good drying properties and the short processing time capabilities.

The following table 8 shows the COD values, and the evolution of SO2 from developing and fixing baths during about 3 hours of working conditions. Either a low index of COD (Chemical Oxygen Demand) and a low evolution of SO2 are pollution reduction indicators for developing and fixing baths.

TABLE 8

| Processing bath | COD | $SO_2$ evolution for fixing bath | Boric acid in the fixer |
|---|---|---|---|
| D1 c | 105,000 | / | / |
| D2 i | 90,000 | / | / |
| D3 i | 100,000 | / | / |
| D4 c | 200,000 | / | / |
| D5 c | 200,000 | / | / |
| F1 c | 112,000 | 0.12 g/l | present |
| F2 i | 112,000 | 0.05 g/l | present |
| F3 i | 112,000 | 0.05 g/l | absent |

The developer of the present invention has a COD value very low and the fixer of the present invention halves the evolution Of SO2 in the environment. The absence of boric acid is another strong improvement as far as pollution reduction is concerned.

The following table 9 shows the thiosulfate retention (hypo-residual) in processed films.

TABLE 9

| Film | Developer | Fixer | Hypo residual $mg/m^2$ |
|---|---|---|---|
| A1 | D1 c | F1 c | 64 |
| A2 | D1 c | F1 c | 59 |
| A2 | D2 i | F2 i | 1.5 |
| A3 | D4 c | F1 c | 10 |

The data of table 9 show a dramatically reduction in hypo-residual. This means a very high storage stability of the processed films.

EXAMPLE2

The film A2 of example 1 was stored, exposed and developed as for example 1, by employing processor 1, developer D2 and fixer F2, with different amount of Kl in fixing solution. The following table 10 shows the residual stain and silver tone evaluations of the processed film by using different amount of Kl in the fixer. The evaluation has been expressed by scholastic scores as for table 4 of example 1.

TABLE 10

| Kl in fixing solution mg/l | Residual stain | Tone |
|---|---|---|
| / | 6 | 2 |
| 10 | 6 | 2 |
| 30 | 6 | 4 |
| 50 | 7 | 6 |
| 70 | 7 | 7 |
| 200 | 7 | 7 |

The data of table 10 clearly show the improvement in silver tone provided by the Kl addition.

EXAMPLE3

The film A2 of example 1 was stored, exposed and developed as for example 1, by employing processor 1, developer D6 and fixer F2. Developer D6 has the same composition of developer D3, but boric acid has been omitted. The amount of KOH has been adjusted to obtain the desired pH. The following Table 11 resumes the sensitometric and physical characteristics of the processed film A2. The scholastic scores are espressed as for Table 4 of Example 1.

TABLE 11

| Dmin | Dmax | Speed | Contr. | Roller mark | Hard mottle | Stain | Tone |
|---|---|---|---|---|---|---|---|
| 0.21 | 3.65 | 2.59 | 2.65 | 6 | 7 | 5 | 6 |

Both the sensitometric and phisical characteristics of processed film A2 are not worsened by the absence of boric acid into the developer of the present invention. By employing processor 2, the processing time needed to get the same values of standard sensitometry was about 35 seconds. The omission of boric acid further improves the good environmental properties of the processing chemistry of the present invention.

EXAMPLE4

A silver halide emulsion comprising cubic silver bromide grains having a diameter of 0.25 μm was chemically sensitized with n-methylthiosuccinimide, gold, sodium p-toluenethiosulfonate and sodium p-toluenesulfinate and spectrally sensitized to infrared radiation by means of a dye sensitizer having its absorption maximum at 820 nm and a bistriazinylaminostilbene fluorescent brightener as supersensitizer. Before addition of dye and supersensitizer the pH of the emulsion was adjusted to 7.0. The emulsion was coated on one side of a polyethylene terephthalate support base at a silver coverage of 2.2 g/m$^2$ with 25.1 mg/m$^2$ of formaldehyde hardener.

Simultaneously with the emulsion layer, a protective layer was coated on the emulsion layer at a gelatin coverage of 0.7 g/m$^2$.

The so obtained infrared sensitive silver halide photographic film A4 showed a melting time of 90 minutes and a swelling index of 90%.

The infrared sensitive film A4 was exposed in a Linotype Linotronic 200 SQ imagesetter equipped with an infrared laser diode exposure source operating at 820 nm (having a resolution from 635 to 1693 dots per inch and a laser density from 1 to 999 units).

The infrared sensitive film A4 was developed as for example 1, by employing processor 1, developer D3 and fixer F2. The following Table 12 resumes the sensitometric and physical characteristics of the processed film A4. The scholastic scores are espressed as for Table 4 of Example 1.

TABLE 12

| Dmin | Dmax | Speed | Contr. | Roller Mark | Hard Mottle | Stain | Tone |
|---|---|---|---|---|---|---|---|
| 0.18 | 3.50 | 1.50 | 2.80 | 7 | 7 | | 7 |

By employing processor 2, the processing time needed to get the same values of standard sensitometry was about 35 seconds.

We claim:

1. A method of processing an image-wise exposed silver halide photographic material comprising a support and at least one silver halide emulsion layer coated thereon, wherein said method comprises the following steps:

(a) developing the photographic material for 5 to 15 seconds in an aqueous developing solution comprising:
  (1) at least one black-and-white developing agent,
  (2) at least one black-and-while auxiliary developing agent,
  (3) at least one antifoggant,
  (4) at least one sequestering agent,
  (5) sulfite antioxidant, and
  (6) at least one buffering agent, (b) fixing the photographic material for 5 to 15 seconds in an aqueous fixing solution comprising:
  (1) at least one fixing agent,
  (2) at least one acid component, and
  (3) at least one buffering agent, and (c) washing the photographic material for 5 to 20 seconds, wherein both said developing and fixing solutions are free of boric acid and gelatin hardeners, the total processing time is less than 45 seconds, and at least one layer of said at least one silver halide emulsion layer i) contains tubular silver halide grains having an average diameter to thickness ration of at least 3:1 and highly deionized gelatin, ii) comprises highly deionized gelatin, and iii) has a swelling index lower than 140% and a melting time of from 45 to 120 minutes.

2. The processing method of claim 1 characterized in that the total processing time is lower than 30 seconds.

3. The processing method of claim 1 characterized in that said fixing solution comprises a soluble iodide salt.

4. The processing method of claim 1 wherein said highly deionized gelatin has a $Ca^{++}$ content lower than 50 ppm.

5. The processing method of claim 1 wherein said tabular silver halide grains have an average diameter ranging from about 0.3 to 5 micrometers.

6. The processing method of claim 1 wherein said tabular silver halide grains have an average thickness of 0.4 micrometers or less.

7. The processing method of claim 1 wherein not less than 40% of the silver halide grains are tabular silver halide grains having an average diameter:thickness ratio of at least 3:1.

8. The processing method of claim 1 wherein said silver halide grains are silver bromoiodide grains comprising an amount of from 0.5 to 1.5 mol % of iodide relative to the total halide content.

9. The processing method of claim 1 characterized in that said fixing solution comprises a soluble iodide salt.

10. The processing method of claim 1 wherein at least one layer of silver halide emulsion in said photographic element comprises tabular grains having an average length to thickness ratio of between 3:1 and 14:1.

11. The processing method of claim 10 wherein said photographic element comprises at least two silver halide photographic emulsion layers, with at least one silver halide photographic emulsion layer on each side of said support.

12. The processing method of claim 11 wherein said at least two silver halide emulsion layers have been hardened by a bi-, tri-, or tetra-vinylsulfonyl substituted organic hydroxy compound.

13. The processing method of claim 10 wherein said at least one silver halide emulsion layer has been hardened by a bi-, tri-, or tetra-vinylsulfonyl substituted organic hydroxy compound.

14. The processing method of claim 10 wherein said at least one silver halide emulsion layer is spectrally sensitized to the red or infrared region of the spectrum.

15. The processing method of claim 1 wherein at least one layer of silver halide emulsion in said photographic element comprises tabular grains having an average length to thickness ratio of between 3:1 and 8:1.

16. The processing method of claim 15 wherein said photographic element comprises at least two silver halide photographic emulsion layers, with at least one silver halide photographic emulsion layer on each side of said support.

17. The processing method of claim 16 wherein said at least two silver halide emulsion layers have been hardened by a bi-, tri-, or tetra-vinylsulfonyl substituted organic hydroxy compound.

18. The processing method of claim 17 wherein said at least two silver halide emulsion layers are spectrally sensitized to the red or infrared region of the spectrum.

19. The processing method of claim 16 wherein said at least two silver halide emulsion layers are spectrally sensitized to the red or infrared region of the spectrum.

20. The processing method of claim 15 wherein said at least one silver halide emulsion layer is spectrally sensitized to the red or infrared region of the spectrum.

21. The processing method of claim 1 wherein said at least one silver halide emulsion layer has been hardened by a bi-, tri-, or tetra-vinylsulfonyl substituted organic hydroxy compound.

22. The processing method of claim 21 wherein said bi-, tri-, or tetra-vinylsulfonyl substituted organic hydroxy compound is used in an amount of from 0.5 to 10% by weight of highly deionized gelatin.

23. The processing method of claim 1 wherein said at least one silver halide emulsion layer is spectrally sensitized to the red or infrared region of the spectrum.

* * * * *

UNITED STATES PATENT AND TRADEMARK OFFICE

CERTIFICATE OF CORRECTION

PATENT NO. : 5,318,881

DATED : June 7, 1994

INVENTOR(S) : Bucci et al.

It is certified that error appears in the above-indentified patent and that said Letters Patent is hereby corrected as shown below:

Column 12, line 55, delete "by to scholastic"
and insert --by scholastic--.

Column 13, line 38, delete "F1i"
and insert --F2i--.

Column 15, line 7, delete "phisical"
and insert --physical--.

Column 16, line 15, delete "tubular"
and insert --tabular--.

Column 16, line 16, delete "ration"
and insert --ratio--.

Signed and Sealed this

Twentieth Day of December, 1994

Bruce Lehman

*Attest:*

BRUCE LEHMAN

*Attesting Officer*

*Commissioner of Patents and Trademarks*